US006398152B1

(12) United States Patent
Burchert et al.

(10) Patent No.: US 6,398,152 B1
(45) Date of Patent: Jun. 4, 2002

(54) BOBBIN PLATE WITH MEANS FOR FORMING A THREAD RESERVE WINDING

(75) Inventors: Mathias Burchert, Deggingen; Günter Baur, Süssen, both of (DE)

(73) Assignees: Fritz Stahlecker, Bad Uberkingen; Hans Stahlecker, Sussen, both of (DE)

( * ) Notice: Subject to any disclaimer, the term of this patent is extended or adjusted under 35 U.S.C. 154(b) by 0 days.

(21) Appl. No.: 09/548,656

(22) Filed: Apr. 13, 2000

(30) Foreign Application Priority Data

Apr. 16, 1999 (DE) ..... 199 17 242

(51) Int. Cl.[7] ..... B65H 65/00; B65H 67/04

(52) U.S. Cl. ..... 242/474.7; 242/475; 242/476.5; 242/476.6

(58) Field of Search ..... 242/474.7, 475, 242/476.5, 476.6, 125.1

(56) References Cited

U.S. PATENT DOCUMENTS 2,262,145 A * 11/1941 Kimpton ..... 242/125.1
2,946,529 A * 7/1960 Stem ..... 242/475
3,801,038 A * 4/1974 Wust ..... 242/487.6
4,106,711 A * 8/1978 Oswald et al. ..... 242/487.6
4,687,148 A 8/1987 Schuller et al.
5,158,241 A * 10/1992 Dammann et al. ..... 242/476.7

* cited by examiner

*Primary Examiner*—Donald P. Walsh
*Assistant Examiner*—Joseph Rodriguez
(74) *Attorney, Agent, or Firm*—Crowell & Moring LLP

(57) ABSTRACT

A bobbin plate is described which is provided with yarn catching slits, with whose aid a yarn reserve winding is formed on a rotating empty bobbin tube. The bobbin plate comprises a base body as well as a nipping ring which can be pressed onto the base body and which nipping ring is flexible at its front side. The base body as well as the nipping ring are each provided with yarn catching slits in such a way that the caught thread can be nipped between the base body and the nipping ring. The supporting surface, on which the bobbin tube is disposed on the nipping ring, is so designed that a relative motion between the bobbin plate and bobbin tube is prevented.

17 Claims, 1 Drawing Sheet

BOBBIN PLATE WITH MEANS FOR FORMING A THREAD RESERVE WINDING

BACKGROUND AND SUMMARY OF THE INVENTION

This application claims priority of German patent application 199 17 242.0, Apr. 16, 1999.

The present invention relates to a bobbin plate rotatable with a bobbin tube and provided with structure for the formation of a thread reserve winding, also comprising a centering collar which engages in the inside of the bobbin tube, a front-sided bearing surface for the bobbin tube, and thread catching slits which extend inwards from the periphery of the bobbin plate in a direction opposite to the rotational direction of the bobbin plate.

A bobbin plate of this type is prior art in U.S. Pat. No. 4,687,148. In the case of such bobbin plates the centering collar has a slightly smaller diameter than the inside of the bobbin tube due to the necessary clearance when placing on the bobbin tube. This results in the bobbin plate running at a higher speed than the bobbin tube during winding of the thread when the bobbin tube is disposed with a certain pressure load on a drive roller. The known bobbin plate utilizes this in that by means of this relative motion, the thread caught in the thread catching slit is taken along and pulled even deeper into the thread catching slit, until it reaches the inside of the bobbin tube. The aim is to avoid a tensile load on the thread end which has a loosening effect on the thread reserve winding.

It is an object of the present invention to ensure the thread reserve winding even when the thread end is not pulled into the inside of the bobbin tube.

This object has been achieved in accordance with the present invention in that the bobbin plate comprises a base body supported in a rotatable way and a resilient nipping ring which can be pressed on its front side by means of the bobbin tube onto the base body, and in that the base body as well as the nipping ring are each provided with thread catching slits, whereby the thread catching slits of the base body and the thread catching slits of the nipping ring are only identical in the peripheral area of the bobbin plate, whereas further inwards, the thread catching slits of the nipping ring are more inclined in radial direction and extend nearer to the centering collar of the base body, and in that the bearing surface located on the nipping ring has a roughness which prevents a relative motion between the bobbin plate and the bobbin tube.

In preferred embodiments of the present invention, each respective slit base of the thread catching slits located in the base body are covered over by the nipping ring in a resilient way, and in reverse, each respective slit base of the thread catching slits located in the nipping ring are covered over by the base body. After being caught, the thread is pulled into the thread catching slit located in the nipping ring right down to the slit base, and thus is held clamped between the base body and the nipping ring. The non-occurring relative motion between bobbin plate and bobbin tube prevents the clamped thread from leaving the clamping point again while the bobbin tube is rotating. This causes a thread reserve winding to be formed at the edge of the bobbin tube which is sufficiently taut.

In preferred embodiments of the present invention it is provided that the base body is provided with a peripheral groove forming two disc-like edge flanges, and that the edge flanges are provided with identical thread catching slits. The base of the peripheral groove lies deeper than the slit base of the thread catching slits located in the edge flanges, so that there is a certain distance between the caught thread and groove base. This distance is utilized in that the caught thread, after it is clamped between the nipping ring and the base body, is cut lightly between the two edge flanges by means of placing a cutting device thereto. The superfluous thread end is then advantageously suctioned off.

It is favorable when the edge flange facing the nipping ring is slightly conical or convex in form on its front side which is disposed on the nipping ring. This causes the nipping ring, after a bobbin tube has been applied, to take its bearing successively from the inside outwards, the nipping ring then releasing the clamping again after the bobbin tube has been removed, so that the thread end of the thread reserve winding is free again for further use after the bobbin tube has been removed.

For this purpose of the present invention, the edge flange facing the nipping ring can have a smaller outer diameter than the other edge flange. This results in the thread to be caught extending slightly inclined right from the start, so that it can be more easily clamped.

These and further objects, features and advantages of the present invention will become more readily apparent from the following detailed description thereof when taken in conjunction with the accompanying drawings.

DETAILED DESCRIPTION OF THE DRAWINGS

Figure 1:
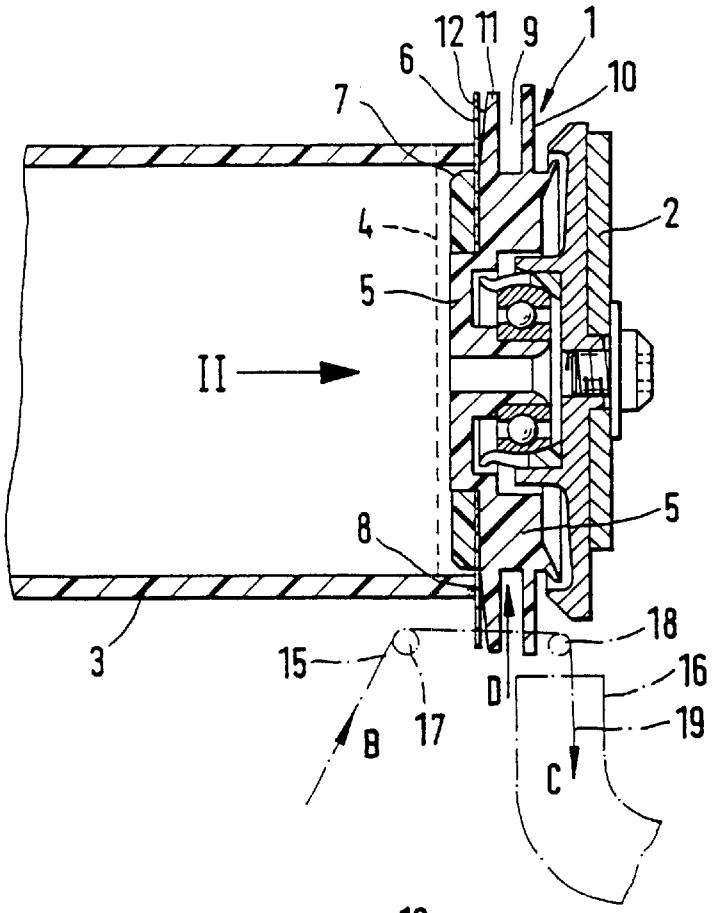
FIG. 1 is a longitudinal section through a bobbin plate, on which a bobbin tube is placed, constructed according to a preferred embodiment of the present invention.
Figure 2:
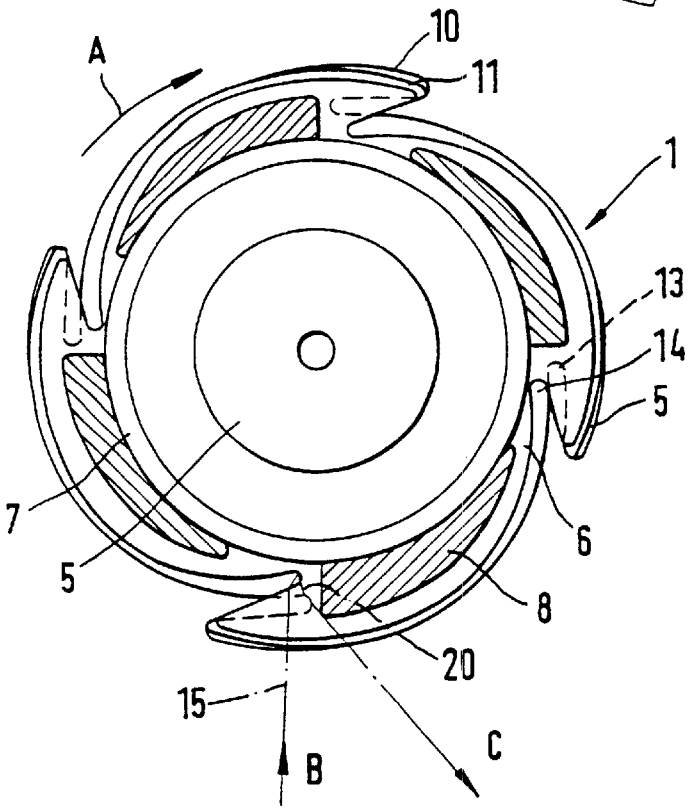
FIG. 2 is a view in the direction of the arrow II of FIG. 1 onto the bobbin plate, without a placed bobbin tube.

The bobbin plate 1 is supported rotatably in a stationary mounted bobbin holder 2. A bobbin tube 3, not yet filled and shown only in FIG. 1 is clamped between the bobbin plate 1 and another bobbin plate (not shown) in such a way that it rotates with the bobbin plate 1. The bobbin tube 3 is hereby disposed on a winding roller (not shown), which drives the bobbin tube 3 in rotational direction A.

After a doffing procedure, when a new bobbin tube 3 in placed in the bobbin holder 2, a thread reserve winding 4 is usually formed at the edge of the bobbin tube 3, which thread reserve winding 4 is indicated in FIG. 1 only by a dotted line. This thread reserve winding 4 serves to join together a plurality of fully wound bobbins for the purpose of further processing.

The thread reserve winding 4 must be sufficiently taut so that it is retained when the bobbin is handled. The thread reserve winding 4 must furthermore be easily created, with no unnecessary thread ends hanging down outside of the thread reserve winding 4. The bobbin plate 1 of the present invention fulfills these requirements.

In contrast to the above mentioned prior art, the bobbin plate 1 of the present invention is made of a plurality of parts. It comprises a base body 5 supported by an antifriction bearing in the bobbin holder 2, and a nipping ring 6 which can be pressed in axial direction onto the base body 5 in a flexible way. The pressure is effected in axial direction by the bobbin tube 3 placed onto the bobbin plate 1. The bobbin tube 3 is disposed during operation on a centering collar 7, which engages in the inside of the bobbin tube 3 and whose outer diameter is slightly smaller than the inner diameter of the bobbin tube 3, so that the necessary clearance is present.

When during operation the bobbin holder 2 is loaded in the direction of the winding roller (not shown), the bobbin plate 1 rotates faster in rotational direction A than the bobbin tube 3 as a result of the above mentioned difference in diameter.

The above mentioned prior art utilizes this faster rotation of the bobbin plate 1 in order to secure the thread reserve winding 4. According to the present invention, the thread reserve winding 4 is to be secured in another way, whereby a relative motion between the bobbin plate 1 and the bobbin tube 3 would be disadvantageous. For this reason, the nipping ring 6, on which the bobbin tube 3 is disposed in axial direction, comprises a front-sided bearing surface 8, whose roughness is of such dimensions that no relative motion between the bobbin plate 1 and the bobbin tube 3 takes place.

The base body 5 comprises a peripheral groove 9, which serves to sever the caught thread in a way described below. Two edge flanges 10 and 11 are formed on the base body 5 at sides of the peripheral groove 9, whereby the edge flange 10 has a slightly larger diameter than the edge flange 11. This results in the caught thread being disposed from the outset slightly inclined, which facilitates the intended clamping of the caught thread, which is described below.

The front side (end face) 12 of the smaller edge flange 11 facing the nipping ring 6 is slightly conical or convex in such a way that the nipping ring 6, under the bearing pressure of the bobbin tube 3, can be disposed successively from the inside outwards.

The thread catching slits 13—for example four in number—applied to the base body 5, which are located in both edge flanges 10 and 11, begin at the periphery of the bobbin plate 1 and extend inwards in an opposite direction to the rotational direction A of the bobbin tube 3. The thread catching slits 13 in both edge flanges 10 and 11, are, apart from the slight difference in diameter, absolutely congruent to one another.

Thread catching slits 14 are also provided in the resilient nipping ring 6, which slits 14, however, differ somewhat in form to the thread catching slits 13. The thread catching slits 14 located in the nipping ring 6 are only identical to the thread catching slits 13 in the peripheral area of the bobbin plate 1. Further inwards, the thread catching slits 14 of the nipping ring 6 are more inclined in radial direction than the thread catching slits 13 and extend furthermore nearer to the centering collar 7 than the other thread catching slits 13, without, however, reaching the centering collar 7 with their slit base. By means of this arrangement of the differing forms of the thread catching slits 13 and 14, the thread, which is disposed in both slit bases, is clamped between the nipping ring 6 and the base body 5. The slit base of the thread catching slits 13 located in the base body 5 is namely covered by the resilient nipping ring 6, and in reverse, the slit base of the thread catching slits 14 located in the nipping ring 6 is covered by the base body 5. The non-occurring relative motion prevents the clamped thread from leaving the clamping point again during the rotation of the bobbin tube 3.

The formation of the indicated thread reserve winding 4 is explained in detail below:

A thread 15 to be caught, shown by a dot-dash line, which for example comes from a spinning aggregate, is fed in feed direction B to the bobbin plate 1 and held taut in a suction direction C by a suction nozzle 16 of a maintenance carriage. The starting position necessary for catching the thread 15 is achieved by two thread guides 17 and 18 of the maintenance carriage (not shown). The thread 15 is thus first brought into the peripheral area of the edge flanges 10 and 11 by means of the thread guides 17 and 18 and by the suction nozzle 16, whereby the thread 15 extends in axial direction in such a way that it can be caught by the thread catching slits 13 of the base body 5 and the thread catching slits 14 of the nipping ring 6 in a known way.

The caught thread 15 is taken along in peripheral direction due to the rotational movement of the bobbin plate 1 in rotational direction A. As the thread catching slits 13 do not extend to the base of the peripheral groove 9, the thread is at a certain distance therefrom. After one rotation it is thus possible to cut the caught thread 15 with a cutter belonging to the maintenance carriage, which cutter can be advanced in arrow direction D.

Due to the particular form, already described, of the thread catching slits 14 of the nipping ring 6, the caught thread 15 is clamped before being cut between the nipping ring 6 and the base body 5. After being cut by means of the above mentioned cutting device, the thread piece 19 running into the suction nozzle 16 is suctioned off. The thread 15, caught and held fast by clamping, can, with the action of the thread guide 17 and the rotational motion of the bobbin tube 3, now form the thread reserve winding 4, without a loose thread end being located somewhere on the bobbin plate 1. As the bobbin plate 1 does not rotate faster than the bobbin tube 3, the thread reserve winding 4 remains at all times clamped taut. The thread end cannot leave the nipping point 20.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A bobbin plate assembly rotatable with a bobbin tube, comprising:

a centering collar which engages in use in the inside of a bobbin tube, a rotatably supported base body, and a resilient nipping ring pressed in use with an end face front side on the base body by the bobbin tube, wherein the base body as well as the nipping ring are provided with thread catching slits, whereby the thread catching slits of the base body and the thread catching slits of the nipping ring are only identical in a peripheral area of the bobbin plate, whereas further inwards the thread catching slits of the nipping ring are in radial direction more inclined and extend nearer to the centering collar than the thread catching slits of the base body and wherein the bearing surface located on the nipping ring has a roughness which prevents a relative motion between the bobbin plate and bobbin tube.

2. A bobbin plate assembly according to claim 1, wherein the base body is provided with a peripheral groove which forms two disc-like edge flanges, and wherein both edge flanges are provided with identical thread catching slits.

3. A bobbin plate assembly according to claim 2, wherein the edge flange facing the nipping ring is convex or slightly conical on its side disposed on the nipping ring.

4. A bobbin plate assembly according to claim 2, wherein the edge flange facing the nipping ring has a smaller outer diameter than the other edge flange.

5. A bobbin plate assembly according to claim 3, wherein the edge flange facing the nipping ring has a smaller outer diameter than the other edge flange.

6. A bobbin plate assembly operable in use to rotatably support one end of a yarn winding bobbin tube, comprising:

a resilient nipping ring which in use abuttingly clampingly engages an end of a bobbin tube, and a base body carrying the nipping ring, said base body being rotatably supported and having an end abutting the nipping ring at a side opposite the bobbin tube being held in use, wherein said nipping ring and base body include thread catching slits operable to catch and hold a thread end, wherein the thread catching slits of the nipping ring and base body are configured differently so that the thread end is held in the slits without relative rotation of the nipping ring and base body with respect to one another and a bobbin tube being held, and wherein the thread catching slits of the nipping ring are more inclined than are the thread catching slits of the base body in an inner radial section of the nipping ring and base body.

7. A bobbin plate assembly according to claim 6, wherein the thread catching slits of the nipping ring and base body are identical in an outer radial periphery of the nipping ring and base body.

8. A bobbin plate assembly according to claim 6, wherein nipping ring surfaces which in use engage the bobbin tube are roughened to prevent relative rotation between the bobbin plate assembly and bobbin tube.

9. A bobbin plate assembly according to claim 6, wherein the base body is provided with a peripheral groove which forms two disc-like edge flanges, and wherein both edge flanges being provided with identical thread catching slits.

10. A bobbin plate assembly according to claim 9, wherein the edge flange facing the nipping ring is convex or slightly conical on its side disposed on the nipping ring.

11. A bobbin plate assembly according to claim 9, wherein the edge flange facing the nipping ring has a smaller outer diameter than the other edge flange.

12. A bobbin plate assembly according to claim 10, wherein the edge flange facing the nipping ring has a smaller outer diameter than the other edge flange.

13. A bobbin plate assembly according to claim 6, wherein the base body is provided with a peripheral groove which forms two disc-like edge flanges, each of said edge flanges being provided with respective thread catching slits.

14. A bobbin plate assembly according to claim 13, wherein the edge flange facing the nipping ring is convex or slightly conical on its side disposed on the nipping ring.

15. A bobbin plate assembly according to claim 13, wherein the edge flange facing the nipping ring has a smaller outer diameter than the other edge flange.

16. A bobbin plate assembly according to claim 14, wherein the edge flange facing the nipping ring has a smaller outer diameter than the other edge flange.

17. A bobbin plate assembly according to claim 6, comprising a centering collar carried by the base body and operable in use to engage inside a bobbin tube.

* * * * *